US005287582A

United States Patent [19]

Kawai et al.

[11] Patent Number: 5,287,582

[45] Date of Patent: Feb. 22, 1994

[54] ADHERING SUBSTANCE PEELING APPARATUS

[75] Inventors: Norio Kawai; Yoshiki Kitamura, both of Yokosuka, Japan

[73] Assignee: Oppama Kogyo Kabushiki Kaisha, Kanagawa, Japan

[21] Appl. No.: 81,488

[22] Filed: Jun. 22, 1993

Related U.S. Application Data

[63] Continuation of Ser. No. 755,661, Sep. 6, 1991, abandoned.

[30] Foreign Application Priority Data

Sep. 8, 1990 [JP] Japan ..... 2-94717

[51] Int. Cl.[5] ..... A47L 13/08; A47L 11/12

[52] U.S. Cl. ..... 15/93.1; 30/169; 299/37; 173/205

[58] Field of Search ..... 15/93.1; 299/37; 30/169, 277, 277.4; 173/114, 117, 205

[56] References Cited

U.S. PATENT DOCUMENTS

| | | | |
|---|---|---|---|
| 1,838,186 | 12/1931 | Moodhe | 173/205 |
| 2,211,741 | 8/1940 | Elwell | 30/277 |
| 2,869,374 | 1/1959 | Morris | 173/205 |
| 3,449,967 | 6/1969 | Dancsik | 173/205 |
| 3,733,637 | 5/1973 | Becker | 15/93.1 |
| 4,304,047 | 12/1981 | Jesionowski | 30/277 |
| 4,452,316 | 6/1984 | Edwards | 30/277 |

FOREIGN PATENT DOCUMENTS

| | | | |
|---|---|---|---|
| 417169 | 11/1947 | France | 15/93.1 |
| 0929976 | 1/1948 | France | 15/93.1 |
| 1273330 | 8/1961 | France | 15/93.1 |
| 589442 | 3/1959 | Italy | 15/93.1 |

*Primary Examiner*—Edward L. Roberts
*Attorney, Agent, or Firm*—Bauer & Schaffer

[57] ABSTRACT

An adhering substance peeling apparatus provided with a vertically reciprocating scraping blade at the lower end of an operating rod of a proper length so that chewing gum, dirt and other adhering substances adhering to the ground surface or the like may be peeled off while the worker is standing upright.

1 Claim, 6 Drawing Sheets

ADHERING SUBSTANCE PEELING APPARATUS

This is a continuation of Ser. No. 07/755,661, filed Sep. 6, 1991 now abandoned.

FIELD OF THE INVENTION

This invention relates to an apparatus for peeling off chewing gums, dirts and other adhering substances adhering to a station building floor surface, road surface or the like.

BACKGROUND OF THE INVENTION

Heretofore, in the case of removing a chewing gum adhering to a station platform or the like, the worker has worked with a spatula or the like in the hand while bowing or squatting.

However, in peeling off such adhering substance, there have been problems that a force larger than is anticipated is required, a pain accompanies the working posture, the working efficiency is low and the work is long. The present invention is made in view of the above mentioned circumstances and has it as an object to provide an apparatus whereby such adhering substance as is mentioned above can be quickly peeled off in a standing easy working posture.

SUMMARY OF THE INVENTION

The apparatus of the present invention comprises an operating rod of a length operable by the worker while standing, a cam provided below within the above mentioned operating rod, rotated by a prime mover and having a concave-convex cam surface, a scraping blade supporting member inserted into the lower end part of the above mentioned operating rod so as to engage at the upper end with the concave-convex cam surface of the above mentioned cam and to be moved by a predetermined stroke in the axial direction of the operating rod and a scraping blade fixed to the lower end of the above mentioned scraping blade supporting member so that, when the scraping blade is pressed against the ground surface, the above mentioned scraping blade supporting member will engage at the upper end with the concave-convex cam surface of the above mentioned cam and, with the rotation of the above mentioned cam, the above mentioned scraping blade supporting member and the scraping blade fitted thereto will reciprocate in the axial direction of the operating rod and the scraping blade tip will enter between the ground surface and the adhering substance to peel off the adhering substance.

BRIEF DESCRIPTION OF THE DRAWINGS

The drawings show embodiments of the present invention.

DETAILED DESCRIPTION OF THE INVENTION

Figure 1:
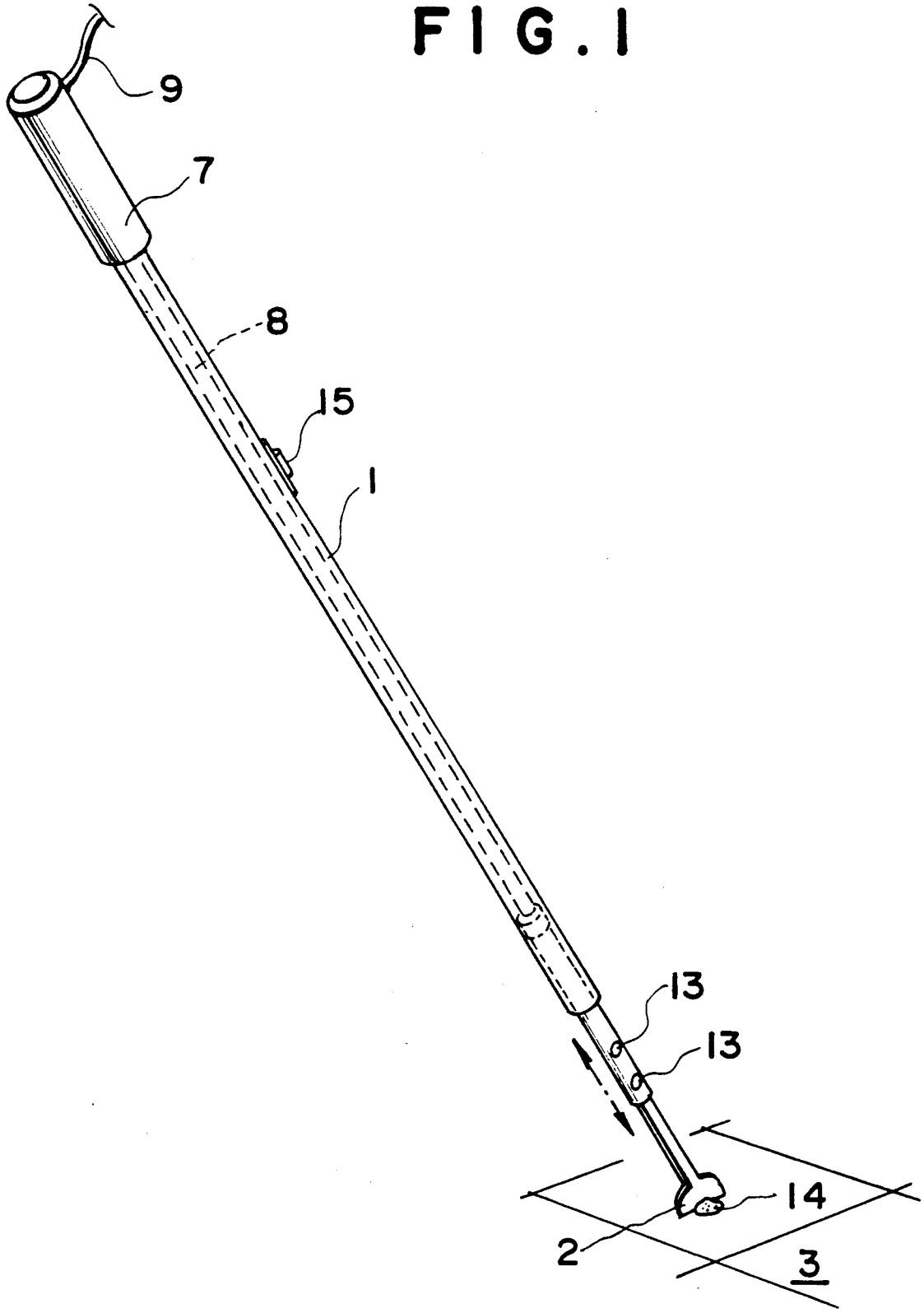
FIG. 1 is a perspective view showing the apparatus of the present invention as being used.

The present invention shall be explained in the following on the basis of the embodiments shown in the drawings.

Figure 2:
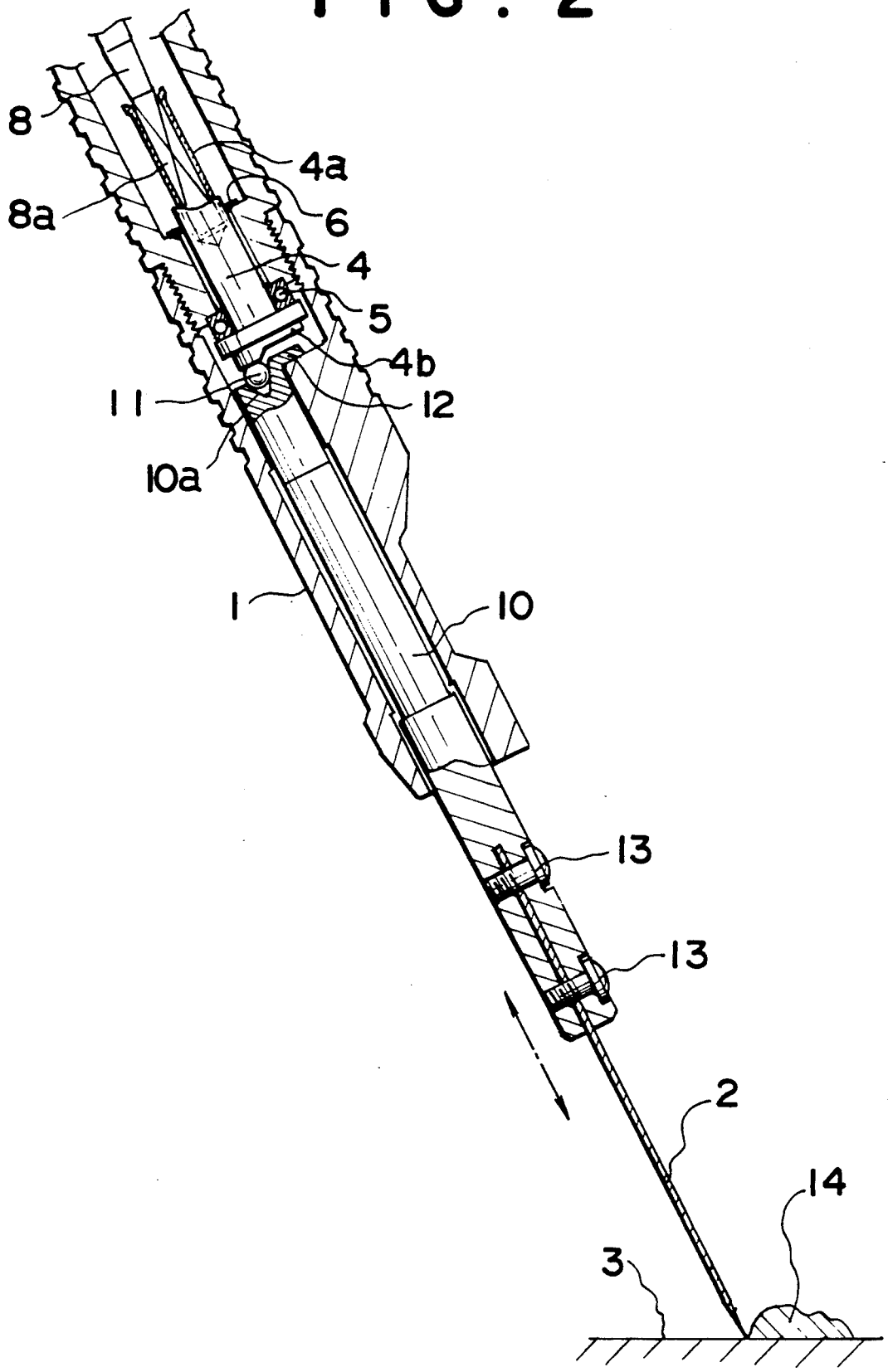
FIG. 2 is a magnified sectioned view of an essential part of FIG. 1.
Figure 3:
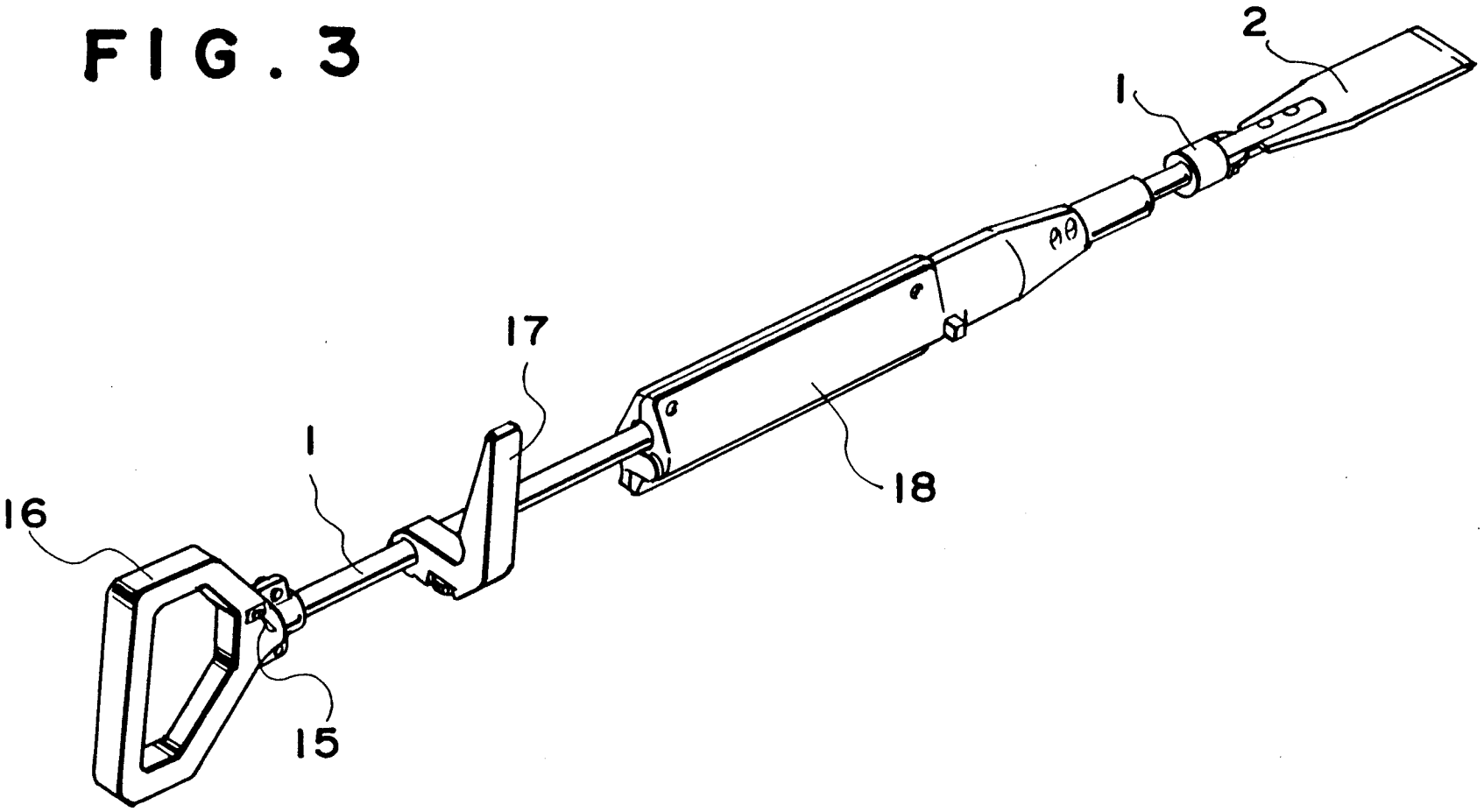
FIG. 3 is a general perspective view showing another embodiment.
Figure 4:
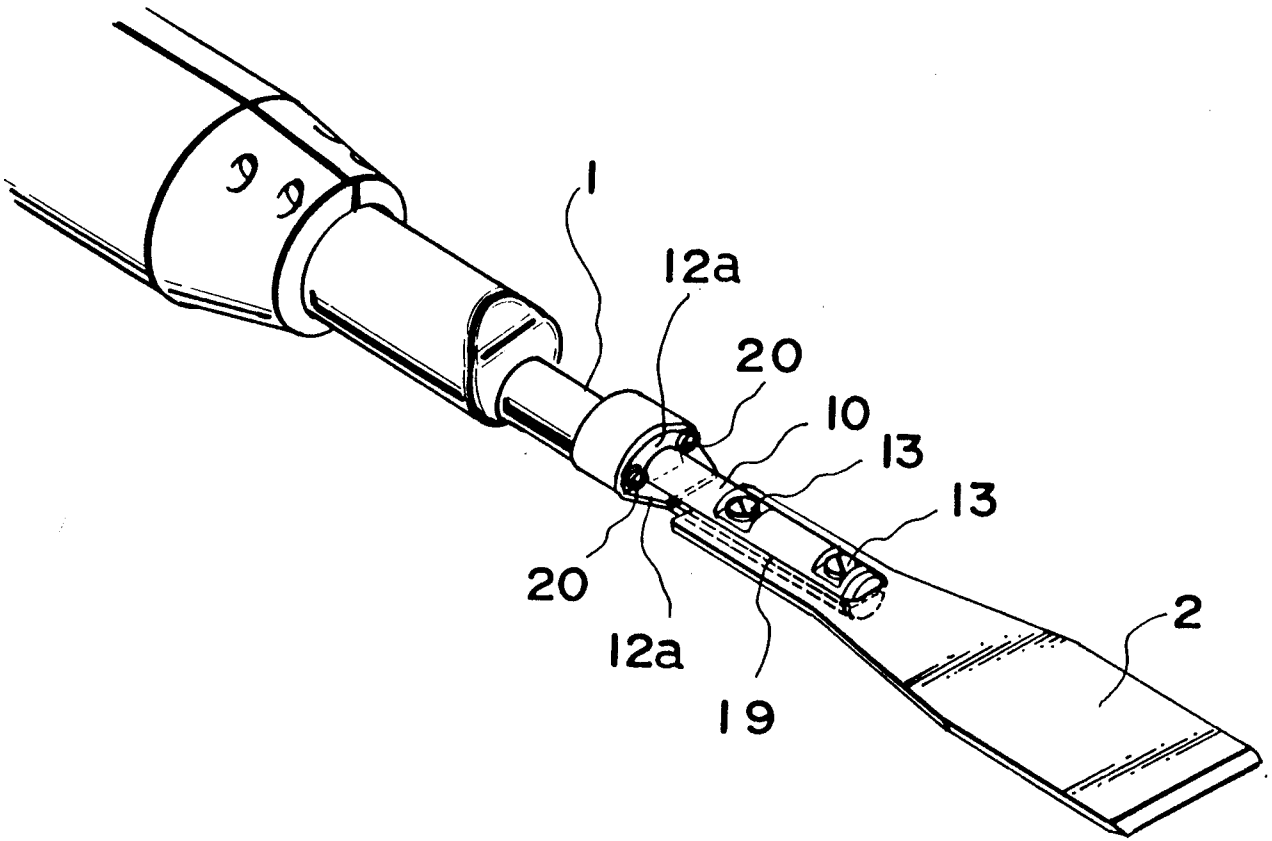
FIG. 4 is a magnified sectioned view of an essential pat of FIG. 3.
Figure 5:
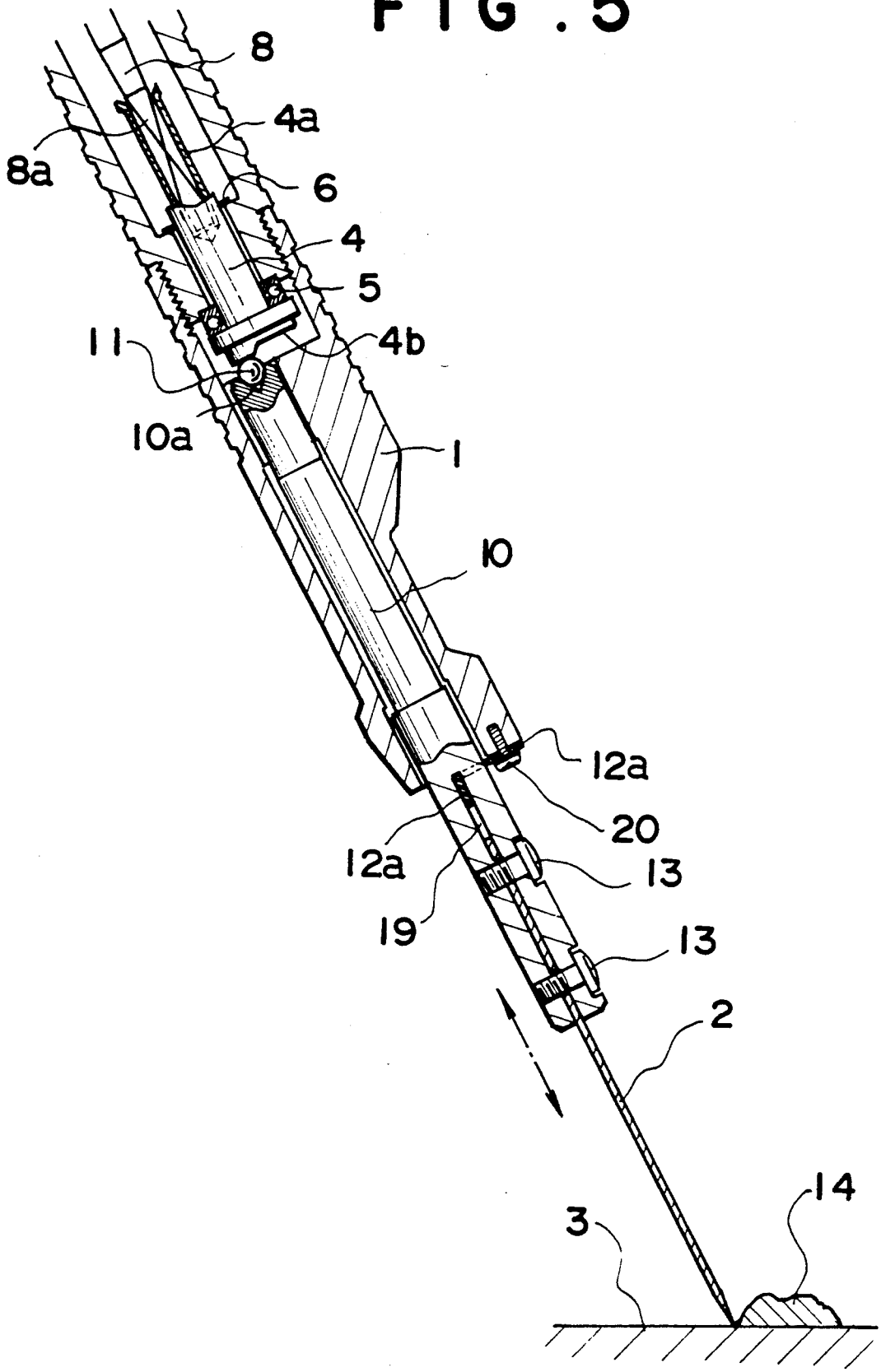
FIG. 5 is a sectioned view of FIG. 4.
Figure 6:
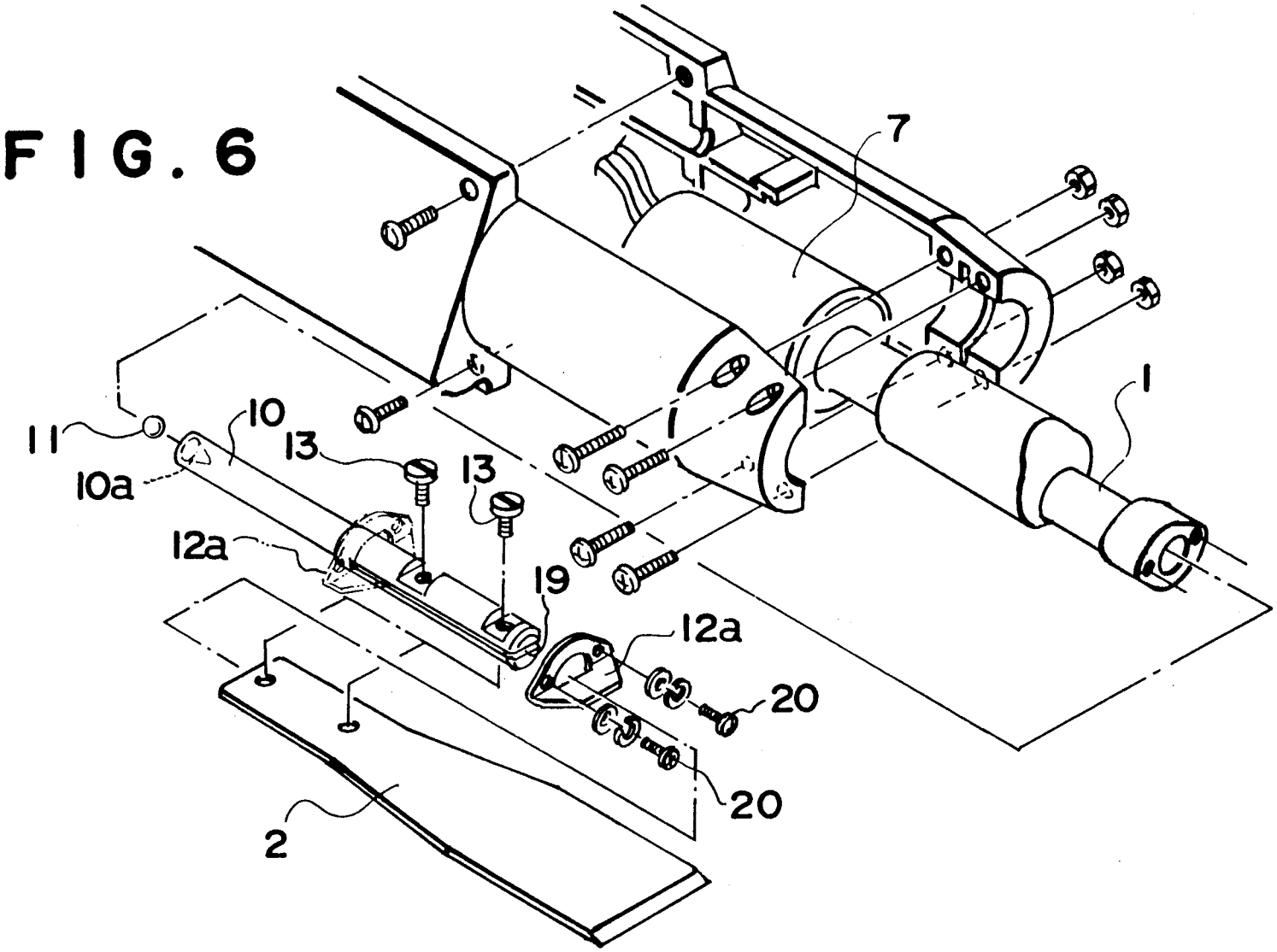
FIG. 6 is a disassembled view of the part shown in FIGS. 4 and 5.

FIG. 1 is a perspective view showing an adhering substance peeling apparatus of the present invention as being used. FIG. 2 is a magnified sectioned view of an essential part of FIG. 1.

In these drawings, the reference numeral 1 represents an operating rod of such length that the worker can work by pressing a later described scraping blade 2 located at the lower end of the operating rod 1 against the ground surface 3 or the like with the operating rod 1 held in a proper position while standing upright without squatting. By the way, as in the other embodiment described later, the operating rod 1 may be provided with a proper handle so as to be easy to be held by the worker.

Further, as shown in FIG. 2, a cam 4 rotated by a prime mover is provided below within the above mentioned operating rod 1, has a concave-convex cam surface **4*b*, can rotate with its axial direction as a rotating center axis below within the above mentioned operating rod 1 and is prevented by a thrust bearing 5 and pulling out preventing member 6 from moving in the axial direction. A prime mover 7 is mounted on the above mentioned operating rod 1 at the rear end and a rotary shaft 8 rotated by the above mentioned prime mover 7 is connected at the lower end to the above mentioned cam 4 at the upper end 4*a* so that the above mentioned cam 4 may be rotated through the rotary shaft 8 by the prime mover 7. In the case of the embodiment in the drawings, an electric motor is used for the above mentioned prime mover 7 so as to be connectable to an outside electric power source through an electric power source cord 9 but a battery may be mounted. An internal combustion engine may be used for the above mentioned prime mover. Also, the prime mover 7 may be borne by the operator on the back separately from the operating rod 1 and may be connected with the operating rod 1 through a flexible shaft or the like so as to be of a so-called back borne type. In the drawings, the reference numeral 15** represents a switch.

A scraping blade supporting member 10 engages at the rear end with the concave-convex cam surface **4*b* of the above mentioned cam 4 and is inserted into the above mentioned operating rod 1 in the lower end part so as to be movable by a predetermined stroke in the axial direction of the above mentioned operating rod 1**.

By the way, in the case of the above mentioned embodiment in the drawings, the above mentioned scraping blade supporting member 10 is provided at the rear end with a concave **10*a* provided with a ball 11 and a pulling out preventing part 12 integrally so that the stroke may be limited lest the above mentioned scraping blade supporting member 10 should move downward of the state shown in FIG. 2 with respect to the operating rod 1**.

When the above mentioned scraping blade supporting member 10 engages at the rear end with the above mentioned concave-convex cam surface **4*b*, that is, through the ball 11 in the case of the embodiment in the drawings, with the rotation of the above mentioned cam 4, the above mentioned scraping blade supporting member 10 will reciprocate in the axial direction of the above mentioned operating rod 1. By the way, a semicircular convex may be formed at the rear end of the scraping blade supporting member 10 instead of the above mentioned ball 11**.

Further, a scraping blade 2 is fixed through screws 13 to the above mentioned scraping blade supporting member 10 at the lower end.

In the scraping apparatus of the above mentioned formation, when the switch 15 is switched on, the above mentioned prime mover 7 is driven, the above mentioned cam is rotated and further the scraping blade 2 is pressed obliquely against the ground surface 3 or the like as shown in FIG. 1 with the operating rod 1, the scraping blade supporting member 10 will be pressed at the rear end through the ball 11 against the concave-convex cam surface **4*b* of the above mentioned cam 4, will engage with the above mentioned cam surface 4*b* and will reciprocate together with the scraping blade 2 in its axial direction with respect to the operating rod 1. Therefore, the scraping blade 2 will enter between the ground surface 3 or the like and such adhering substance 14 as a chewing gum adhering to it so that the above mentioned adhering substance 14** may be scraped off.

By the way, in the apparatus of the above mentioned embodiment, even when the switch 15 is on, unless the scraping blade 2 is pressed against the ground surface 3 or the like, the scraping blade 2 will not reciprocate and will be safe. That is to say, in case the scraping blade supporting member 10 and scraping blade 2 are hung without contacting the ground surface 3 or the like, they will fall down under their own weight and, not as, in the state shown in FIG. 2, the ball 11 will not engage with the concave-convex or particularly with the concave of the cam surface **4*b* of the cam 4 and therefore the scraping blade 2 will not reciprocate. Therefore, when the work is started and the scraping blade 2 is contacted with the ground surface 3 or the like, the scraping blade 2** will begin to reciprocate and will be safe.

In FIGS. 3 to 6 is shown another embodiment which is the same in the essential part as the above mentioned embodiment in FIGS. 1 and 2 but is further embodied as an article.

There shall be described in the following the differences that, first, the operating rod 1 is provided with two handles so as to be easy to operate, second, the operating rod 1 is provided with a housing part 18 for a charged battery or the like so as to be convenient to carry and operable away from a commercial electric power source and, third, the electric motor 7 is provided adjacently to the cam 4 and, fourth, the pulling out preventing member **12*a* for the scraping blade supporting member 10 is provided in the tip portion of the scraping blade supporting member 10**.

The above mentioned pulling out preventing member **12*a* for the scraping blade supporting member 10 is formed to be substantially of an L-shape inserted on one side into a slit 19 provided in the tip portion of the scraping blade supporting member 10 and fixed on the other side to the operating rod I side with screws 20**.

As mentioned above, according to the present invention, chewing gums, dirts and other adhering substances adhering to station building floor surfaces, road surfaces and the like can be quickly peeled off in an easy posture, the adhering substances peeled off may be collected by a vacuum cleaner or the like and the scraping work can be improved in the efficiency.

What is claimed is:

1. A mechanical scraper for removing objects adhered to a floor surface comprising an elongated portable hollow housing manipulatable by the user, a prime mover mounted within said housing, a cam rotatably connected to said prime mover and having a concavo-convex cam surface, a freely axially movable support rod mounted in said housing having an inner end facing said concavo-convex cam surface and a scraper blade fixed at its outer end and normally extending outwardly of said housing and retractable into said housing on engagement with said floor surface, the inner end of said support rod having a conical recess concentric with the axis of said supporting rod in which is received a freely movable ball, said ball engaging the concavo-convex cam surface when said supporting rod is retracted into said housing to cause said support rod to move with a predetermined axial stroke with a minimum of friction.

* * * * *